US006241471B1

(12) United States Patent
Herron

(10) Patent No.: US 6,241,471 B1
(45) Date of Patent: Jun. 5, 2001

(54) TURBINE BUCKET TIP SHROUD REINFORCEMENT

(75) Inventor: William Lee Herron, Greer, SC (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 09/383,712

(22) Filed: Aug. 26, 1999

(51) Int. Cl.[7] ..... F01D 25/04

(52) U.S. Cl. ..... 415/190; 416/191; 416/241 B; 416/500; 415/173.1

(58) Field of Search ..... 416/191, 190, 416/192, 189, 241 R, 241 B, 500; 415/173.1, 173.4, 173.5, 173.6

(56) References Cited

U.S. PATENT DOCUMENTS 4,776,764 * 10/1988 Ortolano ..... 416/190
4,884,820 * 12/1989 Jackson et al. ..... 416/241 R
5,083,903 * 1/1992 Erdmann ..... 416/191
5,120,197 6/1992 Brooks et al. ..... 416/191
5,238,364 * 8/1993 Kreitmeier ..... 415/173.1
5,531,568 * 7/1996 Broadhead ..... 416/191

* cited by examiner

*Primary Examiner*—Edward K. Look
*Assistant Examiner*—Richard Woo
(74) *Attorney, Agent, or Firm*—Nixon & Vanderhye

(57) ABSTRACT

A turbine bucket tip shroud is reinforced by introducing a reinforcing material such as a ceramic-matrix composite as reinforcing rods or bars into the casting of the tip shrouded turbine bucket, to provide resistance to creep deformation. By reducing creep deformation, unlatching of the interlocked tip shrouds is minimized, and bucket overload and vibratory failures are avoided.

18 Claims, 4 Drawing Sheets

TURBINE BUCKET TIP SHROUD REINFORCEMENT

BACKGROUND OF THE INVENTION

The present invention relates to tip shrouded turbine buckets and, in particular, to the reinforcement of the tip shroud to stiffen the shroud and enhance creep life.

Gas turbine buckets or blades are airfoil-shaped components designed to convert the thermal and kinetic energy of flowpath gases into mechanical rotation of the rotor. Turbine performance may be enhanced by providing a seal at the tip of the airfoil to block the flow of air over the top of the airfoil which would otherwise bypass the airfoil and thus not perform any work on the rotor. Thus, such tip seals close the gap between the bucket and the surrounding stationary casings. A variety of seal designs have been developed, all of which require the introduction of a tip shroud to the tip of the airfoil.

A typical tip shrouded turbine bucket configuration is illustrated by way of example in FIGS. 1–5. With reference thereto, a typical gas turbine bucket 10 includes a bucket airfoil 12. This is the active component that intercepts the flow of gases, acting as a windmill vane to convert the energy of the gases into tangential motion, which in turn rotates the rotor to which the buckets are attached. At the top of the airfoil, a seal rail 14 is provided to prevent the passage of flowpath gases through the gap between the bucket tip and the inner surface of the surrounding stationary components (not shown). The seal rail 14 extends circumferentially around the bucket row, beyond the airfoil 12 sufficiently to match up with the seal rails provided at the tip of adjacent buckets, effectively blocking flow from bypassing the bucket row so that airflow must be directed to the working length of the bucket airfoil 12. The tip shroud 16 is added to provide lateral support to the connection also provides a vibrational constraint to the buckets, raising the buckets' natural frequencies and helping to prevent resonance failures.

The tip shroud 16 is essentially a flat plate supported towards its center by the airfoil 12 but subject to high temperatures and centrifugal loads. As a result, material creep becomes a concern. As noted above, the placement of the tip shroud 16 over the airfoil tip allows the airfoil 12 itself to support some of the shroud directly. However, as can be seen from the schematic illustration of FIG. 6, the corners of the shroud are relatively unsupported. Some designs allow for the positioning of the shroud to allow corners corresponding to corners 18 and 26 to be essentially directly over the airfoil 12 but with the consequence that corners 20 and 24 are left quite unsupported. The stiffness of the shroud plate (16) is enhanced by the presence of the seal rail 14. As mentioned above, the shroud is shaped such that the aerodynamic loading on the airfoil causes adjacent shrouds to lock together providing a built in boundary condition for the bucket tip and raising a number of bucket vibrational modes out of the machine operating range. However, creep deformation of the corners of the shroud may result in this locking being lost, lowering the bucket response frequencies, potentially resulting in airfoil high cycle fatigue (HCF) failures.

There have been a number of prior approaches to reduce the problems of shroud creep. For example, the use of directionally solidified or single crystal alloy to enhance creep resistance of the airfoil has been proposed. The complex geometry and tight radii associated with the tip shroud region of the design, however, has prevented bucket casting technology from successfully introducing these features into the tip shroud. Another approach is cooling the shroud. Airfoils themselves may be cooled with, e.g., cooling air introduced at the bucket inner attachment and circulated through the airfoil either through radial passages that are open to the tip of the airfoil or through cast serpentine passages in the airfoil. Again, however, the complexity and size of the tip shroud generally precludes manufacture of such holes in the shrouds, thus preventing active cooling of the shrouds. Finally, modifications to the mechanical design of the shrouds have been considered. Specifically, the shrouds may be shaped or scalloped to reduce centrifugal loads on the corners. This approach has met with significant success but there are limits to its effectiveness, and growth engines will require further enhancements.

BRIEF SUMMARY OF THE INVENTION

The present invention is intended to minimize creep deformation particularly at the unsupported corners of the tip shroud of a turbine bucket. More specifically, in accordance with an exemplary embodiment of the invention, the tip shroud is reinforced by introducing reinforcing bars or rods into the casting to stiffen the shroud and enhance creep life by having the reinforcing bars or rods carry some of the load, reducing the tendency of the shroud to creep. In a presently preferred embodiment of the invention, the reinforcing rods or bars are a ceramic or ceramic-matrix composite. In an exemplary embodiment, the reinforcing rods or bars extend from the relatively unsupported corners of the tip shroud to the region of the seal rail structure.

Thus, the invention is embodied in a tip shrouded blade that comprises an airfoil, a tip shroud provided at a tip of the airfoil, the tip shroud having first and second axial end edges and first and second side edges, and a reinforcing structure integrally formed with the tip shroud, and having a longitudinal axis, wherein the longitudinal axis of the reinforcing structure extends at an angle with respect to a longitudinal extent of the first axial end edge of the shroud.

The invention is also embodied in a turbomachine that includes at least one row of circumferentially engaged tip shrouded blades, each tip shrouded blade including an airfoil, a generally circumferentially extending tip shroud provided at a tip of the airfoil and carried for rotation with the airfoil about an axis, and a reinforcing structure integrated with the tip shroud, each of the tip shrouds being configured for interlock with the tip shrouds of adjacent blades in the row, wherein each reinforcing structure extends at an angle with respect to a circumferential extent of the respective tip shroud.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

The invention proposes to reinforce the strength of the tip shroud 116 of a turbine blade 110, by incorporating reinforcing structure(s) in the tip shroud casting. In accordance with an exemplary embodiment, the reinforcing structures are reinforcing bars 130 formed from, e.g., ceramic or fiber reinforced ceramic-matrix composite, that are introduced into the tip shroud casting to stiffen the shroud and enhance creep life by carrying some of the load imparted on the tip shroud, thereby reducing the tendency of the shroud 116 to creep.

Figure 1:
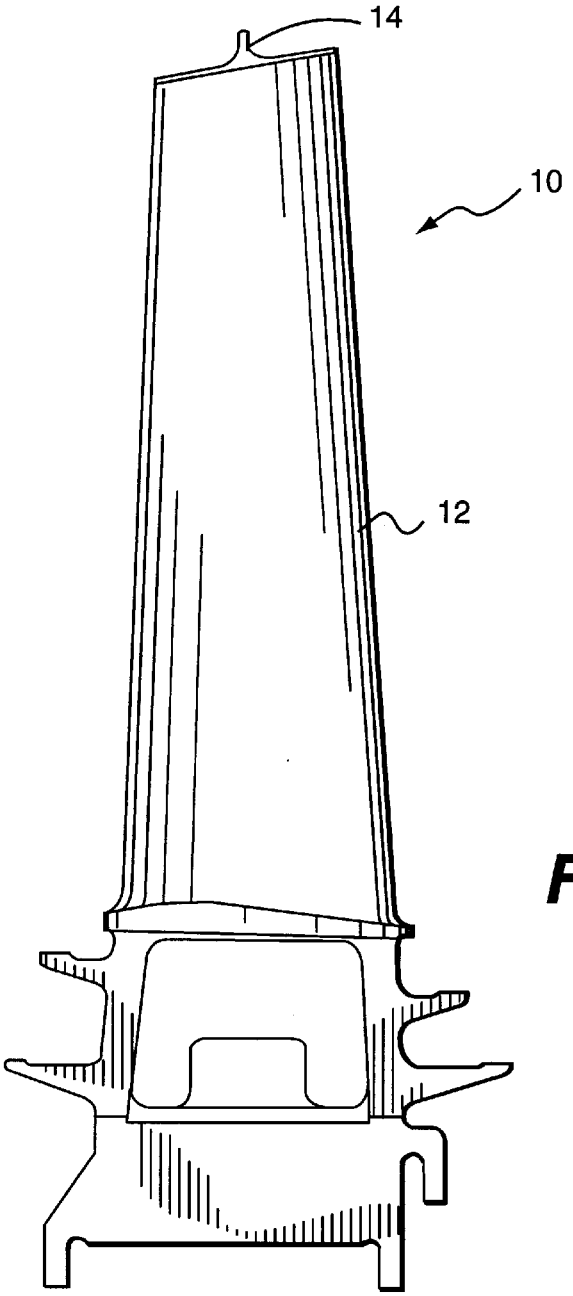
Fig. 1 (Prior Art)
FIG. 1 is a side view of a typical turbine bucket having a tip shroud.
Figure 2:
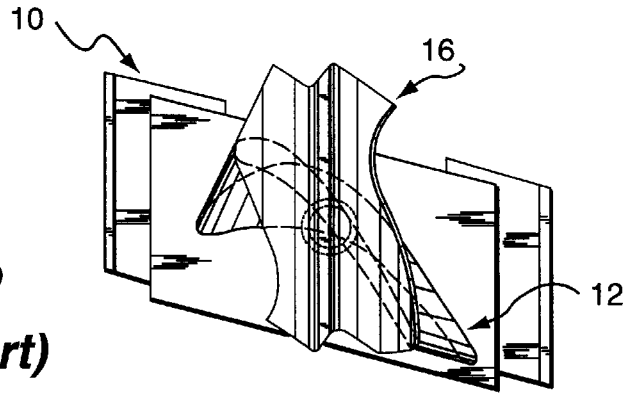
Fig. 2 (Prior Art)
FIG. 2 is a top plan view of the turbine bucket of FIG. 1.
Figure 3:
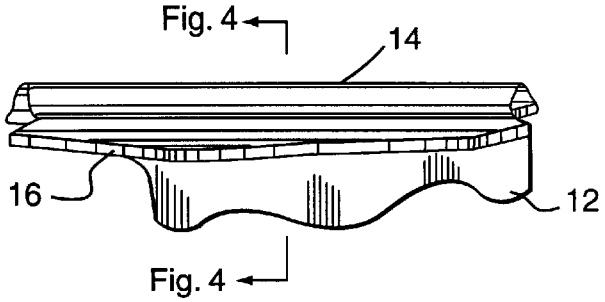
Fig. 3 (Prior Art)
FIG. 3 is a broken away view taken from the left of FIG. 1, showing the tip shroud.
Figure 4:
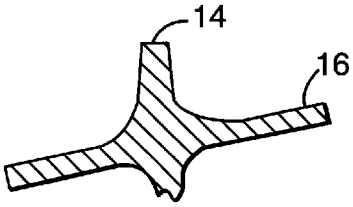
Fig. 4 (Prior Art)
FIG. 4 is a cross-sectional view taken along line 4—4 of FIG. 3.
Figure 5:
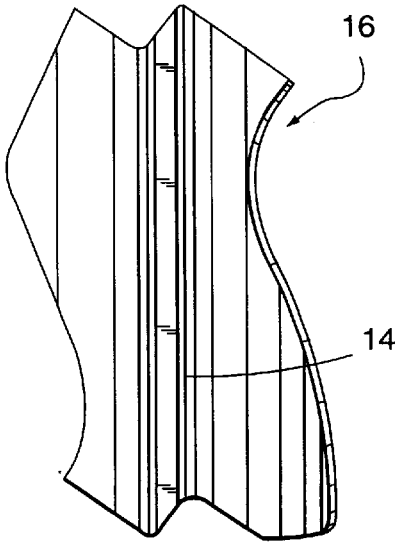
Fig. 5 (Prior Art)
FIG. 5 is a top plan view of the tip shroud of FIG. 3.
Figure 6:
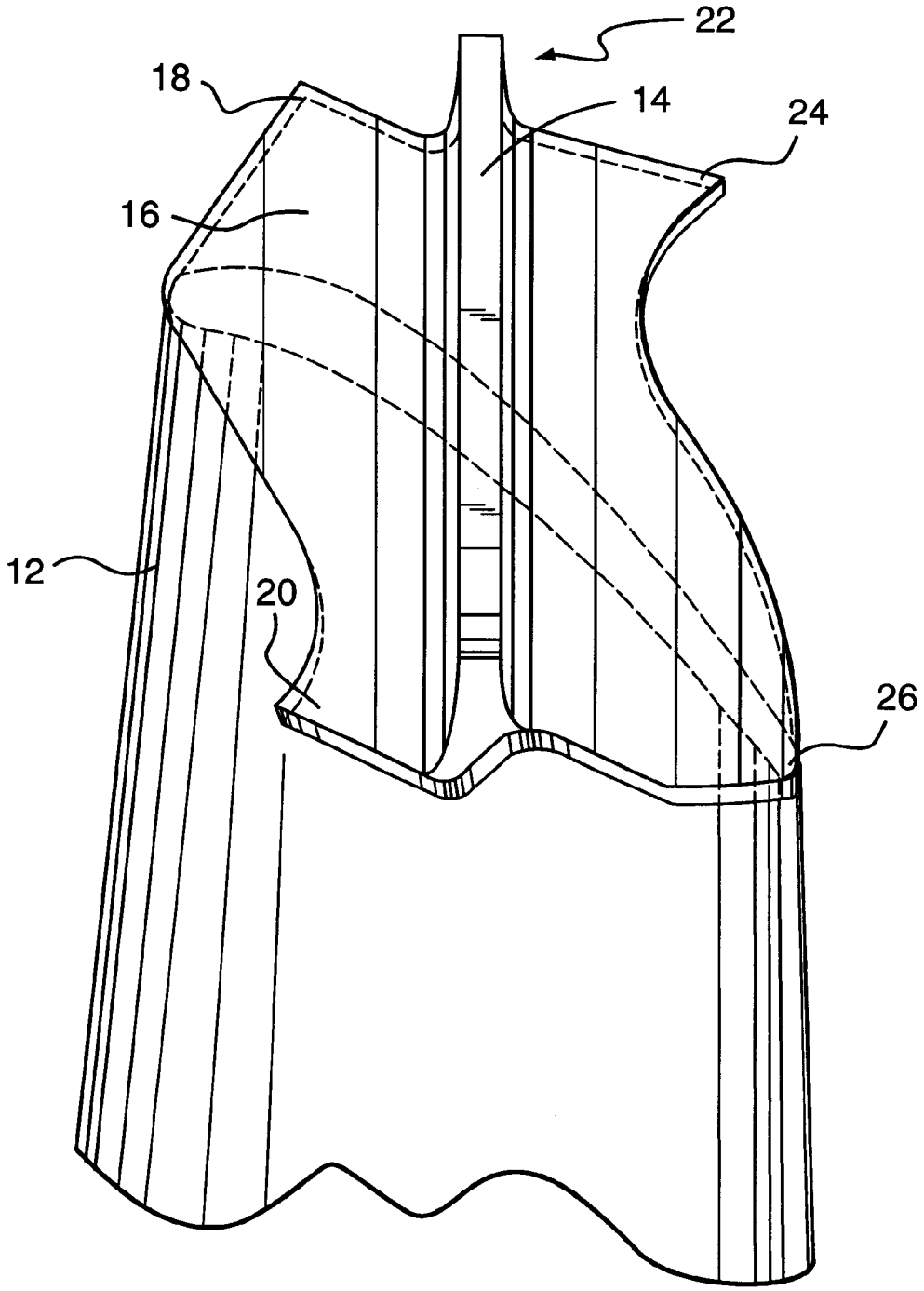
Fig. 6 (Prior Art)
FIG. 6 is a schematic perspective view of a tip shroud structure disposed on a airfoil.
Figure 7:
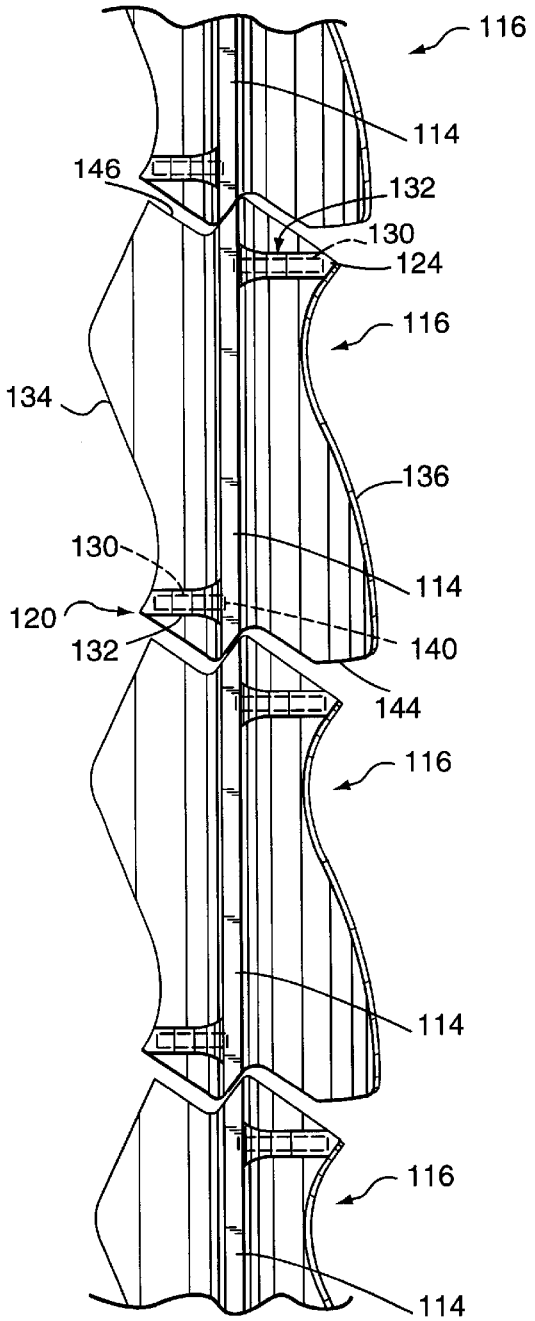
FIG. 7 is a top plan view of a row of circumferentially engaged tip shrouded blades as mounted in a turbomachine, illustrating tip shroud reinforcements in an exemplary embodiment of the invention.
Figure 8:
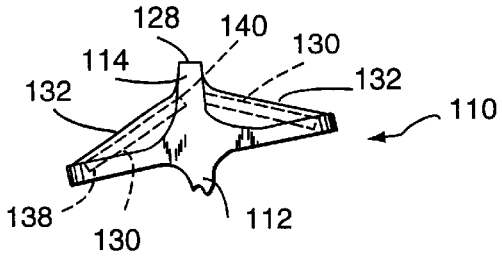
FIG. 8 is a schematic side elevational view of a reinforced tip shroud according to the embodiment of FIG. 7.

In the embodiment illustrated in FIGS. 7 and 8, the reinforcing bar(s) 130 are cast in local webs 132 which are added above the tip shroud plane. More precisely, in the illustrated embodiment, one end 138 of each bar 130 is disposed in the plane of the shroud, adjacent its outer periphery. The bar(s) 130 extend upwardly therefrom and across a portion of the shroud, so that the other end 140 thereof is disposed just below the top or free edge 128 of the seal rail 114. In the illustrated embodiment, two such reinforcing bars 130 and respective webs 132 are provided, extending respectively from each of the unsupported corners 120, 124 of the tip shroud 116. Additional such reinforcements may be provided along the circumferential length of the tip shroud. In this embodiment, the material of the reinforcing bar(s) is selected to exhibit high compressive strength but may have relatively low tensile strength, so as to resist centrifugal loads.

As noted above, the seal rail 114 also reinforces the tip shroud 116. The seal rail 114 extends in a circumferential direction, generally from one side edge 144 to the other side edge 146 thereof, transverse to the axial direction of the shroud 116. Thus the seal rail 114 is generally parallel to the axial end edges 134, 136 of shroud 116. In contrast, the reinforcing webs 132 are disposed at an angle with respect to the axial end edges 134, 136. In the illustrated embodiment, the reinforcing bars 130 and their webs 132 are oriented at an angle of about 90° so as to be generally perpendicular to the circumferential extent of the tip shroud 116, which corresponds to the longitudinal extent of the seal rail 114. As an alternative, however, the reinforcement may be disposed at an angle of less than 90° with respect to the seal rail 114. In that regard, the reinforcing structure is advantageously disposed so as to extend at least from an unsupported peripheral portion of the tip shroud to a supported portion of the tip shroud. Thus, for example, a reinforcing bar or bars may be disposed across the tip shroud from the unsupported corner 120 and/or corner 124 at least to a portion of the tip shroud that either supported, e.g. by airfoil 112, or reinforced, e.g. by rail 114.

As noted above, in the illustrated embodiment, the reinforcing bars 130 are disposed generally above the plane of the tip shroud 116. In the alternative, the reinforcement may be disposed in the mirror image of the illustrated orientation, so as to be disposed generally below the tip shroud plane using, instead of a high compressive strength reinforcement, a high tensile strength composite, in view of the tensile forces to which it will be subjected. This alternative is generally considered less desirable than the disposition of the reinforcement in or above the plane of tip shroud, however, because of the potential for blockage of the gas path and its impact on aerodynamic performance.

To incorporate the reinforcing bar(s) in the tip shroud casting, the bars are fit to extend across a designated tip shroud region in the wax die for the buckets. They are held in position by, for example, being slightly longer than the dimension of the corresponding tip shroud segment. When the wax is injected into the die, these bar(s) will be embedded in the wax molding. The casting shell is then made around the wax in a conventional manner. Since the bar(s) protrude slightly from the wax, however, they will be held in place by the ceramic shell when the wax is removed. The metal is then poured into the ceramic shell and the bar(s) will be embedded in the metal when it solidifies as it is drawn out of the furnace. The exposed tips of the bars may be blended off of the finished casting, leaving the bars themselves embedded in the now solid tip shroud.

In the illustrated and presently preferred embodiment, the reinforcing bars are provided as rod(s) of a ceramic or fiber reinforced ceramic-matrix composite, encapsulated in metal webs. As a further, albeit less desirable, alternative, the webs themselves may be provided to serve as buttresses against tip shroud creep. Such cast webs, however, which lack the ceramic-matrix composite filler, may as a consequence add unacceptable weight to the design. As yet a further alternative, a reinforcing material exhibiting high tensile or bending strength and able to withstand casting temperatures may be incorporated (cast) in the plane of the shroud thereby eliminating the need for projecting webs altogether.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A tip shrouded blade comprising:

an airfoil;

a tip shroud provided at a tip of said airfoil, said tip shroud having first and second axial end edges and first and second side edges; and a reinforcing structure integrally formed with said tip shroud, and having a longitudinal axis, wherein said longitudinal axis of said reinforcing structure extends at an angle with respect to a longitudinal extent of said first axial end edge of said shroud, wherein said reinforcing structure comprises a ceramic or fiber reinforced ceramic-matrix composite.

2. A tip shrouded blade as in claim 1, further comprising at least one seal rail extending across said tip shroud from substantially said first side edge thereof to the second side edge thereof.

3. A tip shrouded blade as in claim 2, wherein said longitudinal axis of said reinforcing structure extends at an angle with respect to a longitudinal axis of said seal rail.

4. A tip shrouded blade as in claim 2, wherein said axial end edges of said tip shroud extend generally in parallel to each other and to a longitudinal axis of said seal rail.

5. A tip shrouded blade as in claim 2, wherein said reinforcing structure extends at least from an unsupported peripheral portion of said tip shroud to said seal rail.

6. A tip shrouded blade as in claim 1, wherein said reinforcing structure extends at least from an unsupported peripheral portion of said tip shroud to a supported portion of said tip shroud.

7. A tip shrouded blade as in claim 1, wherein said reinforcing structure comprises a cast web.

8. A tip shrouded blade as in claim 1, wherein said reinforcing structure extends vertically above a plane of said tip shroud.

9. A turbomachine as in claim 1, wherein each said reinforcing structure extends at least from an unsupported peripheral portion of said respective tip shroud to a supported portion thereof.

10. A tip shrouded blade comprising:

an airfoil;

a tip shroud provided at a tip of said airfoil, said tip shroud having first and second axial end edges and first and second side edges; and a reinforcing structure integrally formed with said tip shroud, and having a longitudinal axis, wherein said longitudinal axis of said reinforcing structure extends at an angle with respect to a longitudinal extent of said first axial end edge of said shroud, wherein said reinforcing structure comprises a cast web, and wherein said reinforcing structure further comprises a reinforcing bar substantially encapsulated in said cast web.

11. A tip shrouded blade as in claim 10, wherein said reinforcing bar is formed from a ceramic or fiber reinforced ceramic-matrix composite.

12. A turbomachine including:

at least one row of circumferentially engaged tip shrouded blades, each said tip shrouded blade including an airfoil, a generally circumferentially extending tip shroud provided at a tip of said airfoil and carried for rotation with the airfoil about an axis, and a reinforcing structure integrated with said tip shroud, each of said tip shrouds being configured for interlock with the tip shrouds of adjacent blades in said row, wherein each said reinforcing structure extends at an angle with respect to a circumferential extent of said respective tip shroud, wherein each said reinforcing structure comprises a ceramic or fiber reinforced ceramic-matrix composite.

13. A turbomachine as in claim 12, further comprising at least one generally radially outwardly projecting seal defined on each said tip shroud.

14. A turbomachine as in claim 13, wherein said seals extend generally circumferentially of said row.

15. A turbomachine as in claim 13, wherein each said reinforcing structure extends at least from an unsupported peripheral portion of said respective tip shroud to the seal thereof.

16. A turbomachine as in claim 12, wherein each said reinforcing structure comprises a cast web.

17. A turbomachine as in claim 16, wherein each said reinforcing structure further comprises a reinforcing bar substantially encapsulated in said cast web.

18. A turbomachine as in claim 12, wherein each said reinforcing structure extends vertically above a plane of said respective tip shroud.

* * * * *